US005251547A

United States Patent [19]

Frigeni

[11] Patent Number: 5,251,547

[45] Date of Patent: Oct. 12, 1993

[54] ROTATING-BELT PRINTING MACHINE FOR TEXTILE PRODUCTS AND THE LIKE

[75] Inventor: Franco Frigeni, Saronno, Italy

[73] Assignee: MS Macchine e Sistemi S.R.L., Bollate, Italy

[21] Appl. No.: 783,791

[22] Filed: Oct. 28, 1991

[30] Foreign Application Priority Data

Oct. 30, 1990 [IT] Italy ..... 21919 A/90

[51] Int. Cl.[5] ..... B41F 13/24

[52] U.S. Cl. ..... 101/232; 271/33

[58] Field of Search ..... 101/118, 232; 271/33

[56] References Cited

U.S. PATENT DOCUMENTS

| | | | |
|---|---|---|---|
| 3,323,700 | 6/1967 | Epstein et al. | 101/118 |
| 3,852,980 | 12/1974 | Zimmer | 101/118 |
| 3,903,792 | 9/1975 | Vertegaal | 101/118 |
| 3,949,864 | 4/1976 | Montsant | 101/118 |
| 4,222,326 | 9/1980 | Mathes et al. | 101/232 |
| 4,238,999 | 12/1980 | Giani et al. | 101/118 |

FOREIGN PATENT DOCUMENTS

| | | | |
|---|---|---|---|
| 40555 | 10/1973 | Australia . | |
| 0253779 | 1/1988 | European Pat. Off. | 271/33 |
| 878186 | 6/1953 | Fed. Rep. of Germany . | |
| 2400728 | 1/1974 | Fed. Rep. of Germany | 101/118 |
| 3308069 | 9/1984 | Fed. Rep. of Germany | 101/232 |
| 1367122 | 6/1964 | France | 101/232 |
| 1220029 | 1/1971 | United Kingdom | 101/232 |
| 2055696 | 3/1981 | United Kingdom | 101/232 |
| 8803118 | 5/1988 | World Int. Prop. O. | 271/33 |

OTHER PUBLICATIONS

"Constant Velocim, Copy Sheet Transport For Ink Jet Printing" Xerox Disclosure Journal, vol. 8, No. 1, Jan.-/Feb. 1983, pp. 19-20.

*Primary Examiner*—Eugene H. Eickholt

*Attorney, Agent, or Firm*—Guido Modiano; Albert Josif

[57] ABSTRACT

Printing machine with rotating belt for textile products and the like, including a supporting structure which extends vertically, a plurality of motorized and mutually synchronized traction rollers arranged in superimposed pairs, and a belt which is closed in a loop, is guided on the rollers of each pair without tension in the axial direction and which has such an extension as to form, between the pairs of rollers, at least one wide loop essentially shaped like a U which has a horizontal axis and extends in depth so as to create, between the lower pair of rollers and the upper adjacent one, a portion of horizontal belt in order to allow printing by at least one printing head.

7 Claims, 1 Drawing Sheet

ROTATING-BELT PRINTING MACHINE FOR TEXTILE PRODUCTS AND THE LIKE

BACKGROUND OF THE INVENTION

The present invention relates to a rotating-belt printing machine for textile products and the like.

As is known, various types of printing apparatus are used for the single- or multiple-color printing of textile products. Such apparatuses differ from one another in the printing methods and the printing devices used according to the productivities and quality of the finished product required.

In particular, planar frame printing systems are known which use a very long fixed table on which the fabric is placed and on which a frame-holder carriage slides and moves along the table with ratios which can vary according to the ratio of the drawing, using lateral sliding guides which are equal to the length of said table.

This system is used for relatively low and good-quality quantities of product, since the operator constantly monitors the printing process and can perform correction at every stroke, but the dimensions of the tables and the deformations which can occur in guides of such length make work very difficult and require large areas for installation.

Other known printing systems relate to rotary machines, i.e. machines which use the rotation of the belt and which maintain the printing stations fixed for the simultaneous printing of multiple colors.

However, said machines, which due to the plurality of printing stations allow considerable productions, do not ensure a perfect execution of the product, also due to the registration systems used, which consist of mechanical or hydraulic clamps which grip the belt at its sides and push it into registration by referring to external stroke limits. These systems can cause considerable problems, since the clamps do not ensure a perfect grip due to slippages and most of all, even in the case of very small errors, cannot ensure re-registration after a considerable number of rotations of the belt.

Other planar frame machines use the rotation of the belt stretched between two end cylinders, reducing the area occupation with respect to conventional planar fixed tables.

SUMMARY OF THE INVENTION

The aim of the present invention is to provide a rotating-belt printing machine which is structured so as to ensure high-quality and high-productivity printing in a space equal to half, or even less than half, of that of all known conventional systems.

Another object of the invention is to provide a machine of the above specified type which is structured so that, by virtue of the use of a particular read system, which is stably and rigidly associated with the belt and is combined with a system for detecting the fixed registration at the printing station, allows to calculate, by means of a computer, perfect printing re-registration even if said registration is not a submultiple of the length of the belt.

A further object of the invention is to provide a printing machine wherein most of the belt which supports the printed product is gathered in a very small space and can thus be subjected to the drying operation at reduced temperatures and for rather long times, with obvious advantages as regards the quality of the obtained product.

This aim, these objects and others which will become apparent from the following description are achieved by a printing machine of the planar frame or rotary type, for textile, plastic products and the like, of the type with a rotating belt closed in a loop, which comprises, according to the present invention:

a supporting structure which extends vertically and supports a plurality of motorized and mutually synchronized rollers, arranged with parallel axes and divided substantially in pairs which are arranged on mutually superimposed and spaced planes, a belt which is closed in a loop, is guided on the rollers of each pair without tension in the axial direction, and has such an extension as to form, between the two pairs of mutually superimposed rollers, at least one wide loop essentially shaped like a U which has a horizontal axis and extends in depth so as to create, between the lower pair of rollers and the adjacent upper one, a portion of horizontal belt in order to allow printing by means of at least one planar printing head which is arranged in a fixed position and/or at least one head with rotating cylinders, belt support and guiding means which act along the edge of said belt and are arranged both at the curved regions of the loop or loops of the belt and at all the straight portions of belt which, during translatory motion, must never have the face which bears the printed product in direct contact with rollers or sliding planes, said support and guiding means also comprising means for providing the tension of the belt in a transverse direction.

More precisely, and according to a first embodiment, said motorized and mutually synchronized rollers are arranged at the vertices of a quadrilateral which is arranged vertically, whereas the closed-loop belt, which is guided on the outside of said rollers, has such a length as to have a first horizontal portion, with which at least one print head is associated, then a large free loop above said portion, said loop being arranged symmetrically between the lower pair of rollers and the upper one and in a position which is close to the vertical side of the quadrilateral which is opposite to the one near to said fixed printing head, the forming of said loop between said pairs of motorized rollers giving the appearance of a fork or of a reclined U, having a reduced lengthwise area occupation, to the structure of the machine.

According to another practical embodiment, the printing machine comprises two pairs of mutually superimposed rollers and laterally, between said pairs, at least one further roller which is motorized so as to allow a belt closed in a loop and having a suitable extension to be guided on said rollers so as to form two identical and superimposed loops between the outer pairs of rollers.

Said support and guiding means which act on the opposite edges of the belt are furthermore constituted by a quadrangular box-like body which is rigidly associated with the structure of the machine and is shaped according to the extension of the various portions of the path of the belt, said box-like body being provided with a slit on one side so as to accommodate, inside it, a continuous metallic lamina which is rigidly associated with the edge of the belt and extends along the entire length of said belt, a series of pairs of opposite bearings being anchored to said metallic lamina, said pairs of bearings being equally spaced and rotating in contact with the inner face of the side of the box-like body which bears said slot so as to keep the belt under traction in a lateral direction, whereas a further series of opposite rollers, which also act on the edge of the belt to the side of the box-like body and can rotate about axes which are rigidly associated with said box-like body, constitutes means suitable for keeping the belt and related pairs of bearings aligned inside the box-like body along the entire path of the belt.

BRIEF DESCRIPTION OF THE DRAWINGS

Further characteristics and advantages of the present invention will become apparent from the following detailed description of some practical embodiments thereof, which is given with reference to the accompanying drawings, given only by way of non-limitative example, wherein.

DESCRIPTION OF THE PREFERRED EMBODIMENTS

Figure 1:
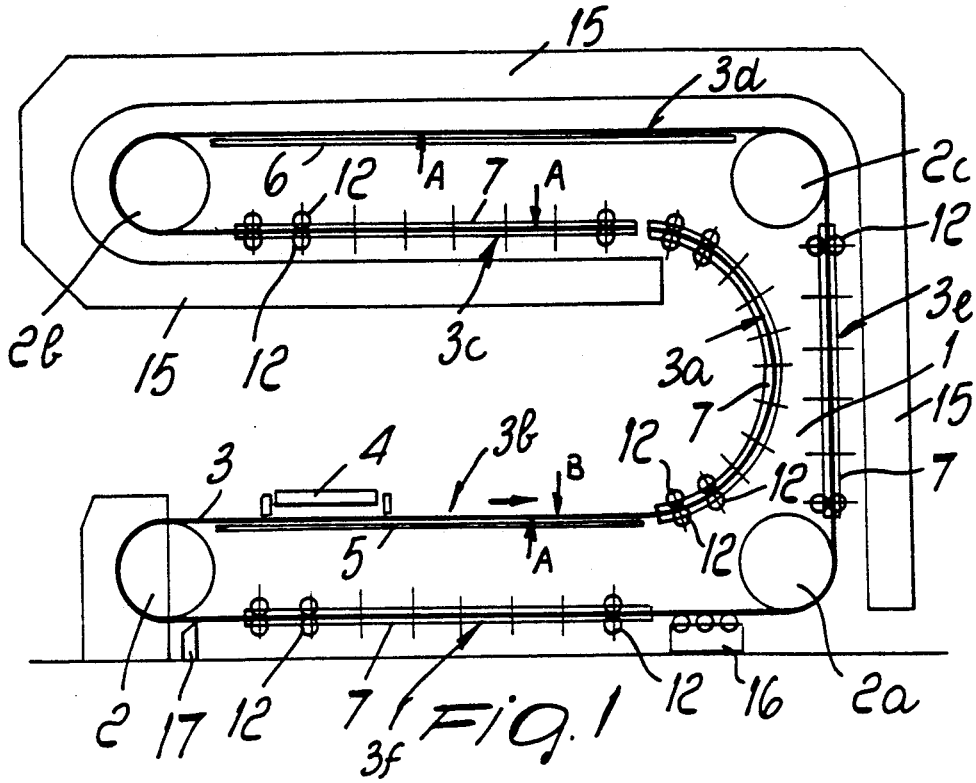
FIG. 1 is a schematic view of a planar frame printing machine according to the present invention.
Figure 3:
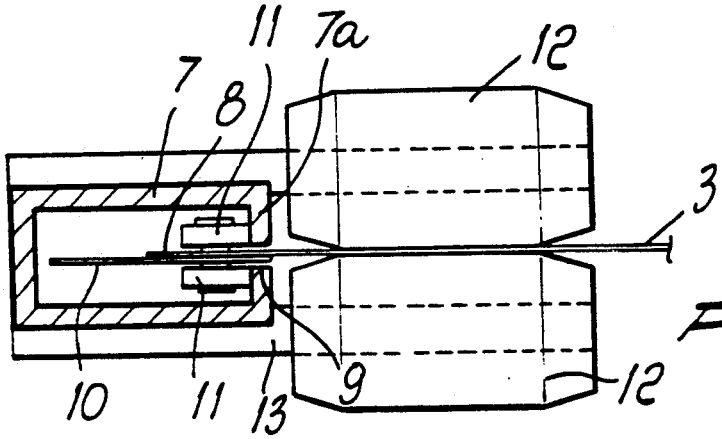
FIG. 3 is a sectional view, taken transversely with respect to the extension of the rotating belt, of a device for supporting and guiding the rotating belt.

With reference to the above figures, and in particular to FIGS. 1 and 3, the printing machine according to the invention comprises, according to a first and preferred embodiment thereof, a supporting framework 1, which extends vertically and at the base of which there is a pair of rollers 2-2*a* with parallel axes, whereas at the top of said framework there is a second pair of rollers 2*b*, 2*c* the axes whereof are parallel to those of the underlying pair. The center distance between the base rollers 2-2*a* is preferably, but not exclusively, equal to the center distance between the two upper rollers 2*b*, 2*c*, and said center distance is provided such as to be in practice equal to approximately half (or even less than half) of the distance between the actuation roller and the transmission roller provided in known machines having a rotating belt stretched between said rollers.

All the rollers 2 to 2*c* are motorized and mutually synchronized by means of known electromechanical systems, and a ribbon or belt 3 is guided, as shown in FIG. 1, on said rollers; said belt 3 is closed in a loop and is intended to support and convey the product to be printed at at least one known planar and/or rotary printing unit 4 which is arranged above the first horizontal portion of the belt. The product to be printed is fixed on the belt 3 by sizing in a known manner by means of an adhesive. The length or extension of the belt 3 is much greater than that which would be required by a belt closed in a loop and wound under tension around said four rollers.

The belt 3 is guided without axial tension in the axial direction which is lengthwise said belt 3, and its greater length is absorbed by the forming of a large circular loop 3*a* which said belt forms before it is wound around the upper roller 2*b*.

The path of the belt 1 is therefore provided so as to form a first horizontal portion 3*b* on which the printing unit 4 acts, a subsequent portion 3*a* curved in a half-circle, a further straight portion 3*c* which is parallel to the lower portion 3*b*, then an equally straight portion 3*d*, then a vertical straight portion 3*e*, and finally an equally straight portion 3*f* below the first portion 3*b*. Even with this particular arrangement of the belt, the face indicated by B in FIG. 1, which supports the printed product, is always free from any contact with fixed supports or sliding planes which must nonetheless be provided in order to support and guide the belt in its path from the beginning of the printing step up to the recovery of the printed product at the roller 2, as provided by the known art.

The problem of the support and guiding of the belt along its entire path is solved, according to the invention, by moving the face (indicated by A in FIG. 1) of the belt, in the horizontal portion 3*b*, along a conventional sliding plane 5 which is anchored to the framework so as to be fixed and by moving the face A, in the upper portion 3*d* as well, on a sliding plane 6, whereas support and guiding devices, of the type illustrated in FIG. 3, are used in order to support the curved portion 3*a* and the straight portions 3*c*-3*f*, which cannot be supported by rollers or sliding planes since their face B which supports the printed product would be in contact with the supports.

Said support and guiding devices are constituted by a substantially quadrangular box-like body 7 which is anchored to the fixed framework 1 and is shaped so as to react on the curved belt portion 3*a* and on the straight portions 3*c* and 3*f*; said box-like body 7 is continuous and is arranged at both edges of the belt 3, so as to allow the edges 8 of said belt to partially penetrate and slide within the respective box-like body through a continuous slit 9 defined in the side 7*a* which is perpendicular to said belt; a continuous and flexible metallic lamina 10 is furthermore anchored to the belt portions 8 and is such as to be able to follow the path of the belt even in the curved portions around the motorized rollers and in the curved portion constituted by the loop 3*a*; the function of the lamina 10 will be explained hereinafter.

In order to keep the edges 8 of the belt guided within the box-like supporting body, a series of pairs of free bearings II is anchored to said edges; said bearings are opposite and equidistant, and can rotate about axes which are rigidly associated perpendicularly to the edges 8 and are arranged in contact with the inner wall of the side 7*a* which is provided with the continuous slit 9. The pairs of bearings 11 are arranged so as to exert, in cooperation with the corresponding pairs of bearings provided on the opposite edge of the belt, a continuous lateral traction on said belt which allows to support it and guide it along its entire path.

In order to then keep aligned the belt and the bearings within the opposite box-like bodies there is a series of pairs of mutually opposite free rollers 12 which act on the opposite faces of the belt and are freely rotatably mounted on shafts 13 which are rigidly associated with the box-like bodies.

Said support and guiding means can also be provided on the sides of the vertical portion 3*e* of the belt if the distance between the rollers 2*a* and 2*c* is such as to require the stabilization of the belt.

The metallic laminae 10, or at least one of said laminae, are or is provided, in the portion which is external to the bearings 11, with one or more series of equidistant holes which are suitable for allowing the application of a known apparatus for the continuous detection and measurement of the linear motions of the belt.

In particular, said known apparatus for detecting and measuring the linear motion of the belt is arranged in a fixed position proximate to said printing station and comprises a device for detecting the movement and alignment of the belt of the type with gears arranged so as to constantly mesh within said identical and mutually equidistant holes defined on the lamina 10 which is associated with the peripheral edge 8 of said belt, and a rotary transducer of a known type, substantially an incremental encoder associated with said geared detector, which is suitable for providing in output electric signals which can be converted, by virtue of control means operatively associated with said encoder and with the belt actuation motors, into electric signals for controlling said motors.

More particularly, said device for detecting the movement and alignment of the belt is constituted by gears which are arranged with a horizontal axis and which are free about their own axis; at least one of said gears is arranged before the printing station and at least one is arranged thereafter, so as to ensure, besides the detection of the movements of the belt, also a perfect alignment, both longitudinally and transversely, of said belt at least in the belt portion affected by the printing operation.

Figure 2:
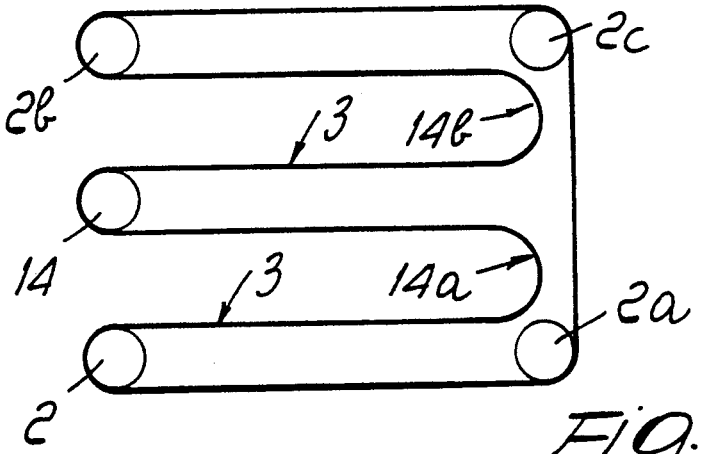
FIG. 2 is schematic view of another aspect of the printing machine according to the invention.

Still according to the invention, another embodiment of the printing machine with reduced lengthwise area occupation can consist in providing, as shown by FIG. 2, at least one further motorized roller 14 which is interposed between the pairs of superimposed rollers 2—2*a* and 2*b*—2*c* and is synchronized therewith so as to allow the belt 3, which is also closed in a loop and has an appropriate extension, to form two wide mutually superimposed internal loops 14*a* and 14*b*. In this manner it is possible to use a very long belt which is not under tension between the traction rollers despite reduced lengthwise dimensions of the printing machine.

In this case also, the support and guiding of the belt, in the regions which float because they do not have part of the supporting rollers, can be provided by using the lateral support and tension devices already described with reference to FIG. 3.

The particular configuration of the machine according to the invention also offers the advantage of being able to enclose most of the belt, for example the regions 3*c*–3*d* and 3*e* (FIG. 1), within a drying chamber 15, ensuring an excellent quality of the finished product; in this case the long permanence time of the fabric inside the drying chamber in fact allows to reduce the drying temperature.

The machine according to the invention is finally completed by a belt washing device 16, for washing off the sizing agent which is arranged in the return portion of said belt and by a conventional device 17 for subsequently separating the printed and dried fabric from the belt the device 17 being arranged at the motorized roller 2.

The invention as described above according to some preferred embodiments thereof is naturally in practice susceptible to structurally and functionally equivalent modifications and variations, without abandoning the scope of the protection of the invention.

What is claimed is:

1. Rotating-belt printing machine for textile products and the like, comprising:

a supporting structure which extends vertically and supports a plurality of mutually synchronized motorized rollers which are arranged so that their axes are mutually parallel and are divided substantially in pairs which are arranged on mutually superimposed and spaced planes;

a belt which is closed in a loop, is guided on the rollers of each pair without tension in the axial direction lengthwise said belt, and said belt having such an extension as to form, between the two pairs of mutually superimposed rollers, at least one wide loop essentially shaped like a U which has a horizontal axis and extends in depth so as to create, between the lower pair of rollers and the adjacent upper one, a portion of horizontal belt in order to allow printing by means of at least one printing head;

belt support and guiding means which act along both edges of said belt and which are arranged both at the curved regions of the loop or loops of the belt and at all the straight portions of belt which, during translatory motion, must never have the face which bears the printed product in direct contact with said motorized rollers or sliding planes.

2. Printing machine according to claim 1, wherein said support and guiding means further comprise means for providing the tension of the belt in a transverse direction with respect to said axial direction.

3. Printing machine according to claim 1, wherein said closed-loop belt has such a length as to define a first horizontal portion, with which said at least one printing head is associated, and then a wide free loop, shaped like an arc of a circle, which is arranged in a central position between two mutually superimposed pairs of motorized rollers, a further straight portion which is parallel to said first horizontal portion then an equally straight horizontal portion parallel therewith, then a vertical straight portion and finally an equally straight portion below said first horizontal portion, a belt washing device and a device for separating the printed item being provided at said straight portion below said first horizontal portion.

4. Printing machine according to claim 1, wherein said guiding and support means which act on both edges of the belt comprise a box-like body which is rigidly associated with the supporting structure of the machine and which is shaped according to the extension of the various portions of the path of the belt, said box-like body being provided with a slit on one side so as to accommodate, inside it, a continuous metallic lamina which is rigidly associated with the edge of the belt and which extends along the entire length of said belt, a series of pairs of opposite bearing being anchored to said metallic lamina, said pairs of bearings being equidistant and rotating in contact with the inner face of the side of the box-like body which is provided with said slit so as to keep the belt under traction in a lateral direction, whereas a further series of mutually opposite rollers, which also act on the edge of the belt to the side of the box-like body and which can rotate about shafts which are rigidly associated with said box-like body, constitute means adapted for keeping the belt and the related pairs of bearing aligned inside the box-like body along the entire path of the belt.

5. Printing machine according to claim 1, wherein it comprises at least two pairs of said mutually superimposed rollers and laterally, between said pairs, at least one further roller which is motorized so as to allow a belt closed in a loop and having an appropriate extension to be guided on said rollers so as to form two or more identical or superimposed loops between the outer airs of rollers.

6. Printing machine according to claim 1, wherein said belt at the upper pair of said motorized rollers is enclosed within a chamber for drying the printed fabric at reduced temperature.

7. Printing machine according to claim 1, wherein said machine has a lengthwise dimension equal to approximately half, and even less than half, of that of convention machines or the type having a rotating belt stretched between an actuator roller and a transmission roller.

* * * * *